US007497411B2

(12) United States Patent
Weck et al.

(10) Patent No.: US 7,497,411 B2
(45) Date of Patent: Mar. 3, 2009

(54) ADJUSTABLE HEIGHT HANGERS

(75) Inventors: David Weck, Miami, FL (US); Edson A. Mejia, Miami, FL (US)

(73) Assignee: Micasa Trading Corporation, Miami, FL (US)

( * ) Notice: Subject to any disclaimer, the term of this patent is extended or adjusted under 35 U.S.C. 154(b) by 0 days.

(21) Appl. No.: 11/829,259

(22) Filed: Jul. 27, 2007

(65) Prior Publication Data

US 2009/0026344 A1 Jan. 29, 2009

(51) Int. Cl.
*A47G 1/24* (2006.01)

(52) U.S. Cl. ..... 248/480; 248/495

(58) Field of Classification Search ..... 248/495, 248/476, 493, 494, 466, 477, 480; 411/308, 411/999, 411

See application file for complete search history.

(56) References Cited

U.S. PATENT DOCUMENTS 2,697,572 A * 12/1954 Pfankuch ..... 248/495
3,251,569 A * 5/1966 Rynearson ..... 248/493
4,125,140 A * 11/1978 Basile ..... 411/106
4,566,665 A * 1/1986 Rynearson ..... 248/495
5,154,559 A * 10/1992 Wagner ..... 411/107
6,174,118 B1 * 1/2001 Rebers et al. ..... 411/352
6,582,171 B2 * 6/2003 Bondarowicz et al. ..... 411/353
7,261,273 B2 * 8/2007 Lemire ..... 248/476
7,281,696 B2 * 10/2007 Kida et al. ..... 248/300
2003/0147716 A1 * 8/2003 Nagawa et al. ..... 411/288

* cited by examiner

*Primary Examiner*—Ramon O Ramirez
(74) *Attorney, Agent, or Firm*—Lowe Hauptman Ham & Berner LLP

(57) ABSTRACT

A picture hanger has an upper piece, a lower piece, and a screw that extends through apertures in shelves on bases of the pieces. The aperture on the lower piece has threads mating with the screw threads on the shaft so that when the upper piece is fixedly mounted on the vertical surface by an elongated fastener the lower piece is held in place only by the threads of the shaft engaging the threads in the aperture on the lower piece shelf. The base of the lower piece carries a picture wire receiving hook so that turning the screw enables the height of the picture to be changed. Strengthening ribs extend between the base and shelf of both pieces.

10 Claims, 3 Drawing Sheets

ADJUSTABLE HEIGHT HANGERS

FIELD OF INVENTION

The present invention relates generally to hangers for hanging objects, such as pictures, mirrors, or the like (hereinafter, picture hangers), and more particularly to picture hangers having a fixedly mounted upper piece connected to a lower piece by a threaded member that enables the distance between the upper and lower pieces to be varied.

BACKGROUND ART

A commercially available picture hanger, described in Schrager et al., U.S. Pat. No. 2,522,901, includes a fixedly mounted upper piece and a lower piece connected to the upper piece by a screw that fits into a nut carried below a shelf of the lower piece. The lower piece includes a hook for receiving a picture wire secured to the object to be hung, e.g., a picture. After the upper piece has been secured by nails to a wall or other vertical surface, the distance separating the upper and lower pieces can be varied by turning the screw so that the lower piece and is raised or lowered relative to the upper piece. Raising and/or lowering the lower piece enables the wire and the object to be accordingly raised and/or lowered. Such an arrangement is particularly advantageous in situations where it is desirable to align the straight upper edges of multiple objects mounted on the same vertical surface. Such a hanger is also advantageous when, for example, a person hanging an object wants to prevent any portion of the hanger from being seen by a person viewing the hanging object.

A problem with the prior art, commercially available two-piece picture hanger is that installers find it difficult to grip the small nut in a confined space under a shelf, while turning a screwdriver from above the nut and maintaining the screwdriver in place in a slot arrangement in the head of the screw. Another problem is that heavy pictures or other structures hung on the hook of the lower piece have a tendency to pull the shelf down. Once the shelf is pulled down, it is very difficult to reposition of the lower piece to provide the desired effect of maintaining the top edge of the object at a desired position on the wall. When the shelf is bent, access to the nut is considerably more difficult.

It is, accordingly, an object of the present invention to provide a new and improved picture hanger having upper and lower pieces that are connected to each other by a threaded shaft, for thereby enabling a hook on the lower piece to be moved up and down relative to the upper piece that has been fixed on a vertical surface.

An additional object of the present invention is to provide a new and improved two-piece picture hanger of the described type, wherein adjusting the height of the lower piece relative to the fixed upper piece is facilitated.

Yet another object of the present invention is to provide a new and improved two-piece picture hanger of the described type, wherein a shelf carrying a receptacle for a screw connecting the two pieces together is arranged to provide greater strength to the lower piece to substantially prevent bending of the shelf in response to a load being put on a hook on the lower piece.

SUMMARY OF THE INVENTION

In accordance with one aspect of the invention, a hanger for an object adapted to be hung on a vertical surface comprises an upper piece, a lower piece, and a shaft including threads. Each of the upper and lower pieces includes a base from which extends a shelf with an aperture for receiving the shaft. The apertures on the shelves of the upper and lower pieces enable the shaft to extend through the apertures on the shelves of the upper and lower pieces. The base of the upper piece includes at least one aperture for receiving an elongated fastener, such as a nail, for enabling the upper piece to be fixedly mounted on the vertical surface. The shelf on the upper piece and the shaft enable the shaft to be held vertically in place while the upper piece is fixedly mounted on the vertical surface. The aperture on the shelf of the lower piece includes threads that mate with the threads on the shaft so that when the upper piece is fixedly mounted on the vertical surface by the elongated fastener the lower piece is held in place only by the threads of the shaft engaging the threads in the aperture on the shelf on the lower piece. The base of the lower piece carries a hook for receiving an elongated support structure, such as a wire, attached to the object.

Preferably, a strengthening structure is between the base and shelf of at least one of the upper and lower pieces.

In accordance with another aspect of the invention, a hanger for an object adapted to be hung on a vertical surface comprises: an upper piece, a lower piece, and a shaft including threads. Each of the upper and lower pieces includes a base from which extends a shelf with an aperture for receiving the shaft. The apertures on the shelves of the upper and lower pieces enable the shaft to extend through the apertures on the shelves of the upper and lower pieces. The base of the upper piece includes at least one aperture for receiving an elongated fastener, such as a nail, for enabling the upper piece to be fixedly mounted on the vertical surface. The shelf on the upper piece and the shaft enable the shaft to be held vertically in place while the upper piece is fixedly mounted on the vertical surface. The aperture on the shelf on the lower piece receives the shaft. The shelf on the lower piece is associated with a thread arrangement so that when the upper piece is fixedly mounted on the vertical surface by the elongated fastener, the lower piece is held in place only by the threads of the shaft engaging the threads of the thread arrangement. The base of the lower piece carries a hook for receiving an elongated support structure attached to the object. A strengthening structure is between the base and shelf of at least one of the upper and lower pieces.

Preferably, the strengthening structure includes first and second ribs proximate (a) first and second opposite ends of the shelf and (b) first and second opposite edges of the base of the upper piece.

The strengthening ribs on the upper piece preferably include an arcuate surface having an angular extent of approximately 90°. A first upper end of each arcuate surface abuts the base of the upper piece and a second lower end of each arcuate surface abuts the shelf of the upper piece.

The strengthening ribs on the lower piece preferably include an arcuate surface having an angular extent of approximately 90°. A first lower end of each arcuate surface abuts the base of the lower piece and a second higher end of each arcuate surface abuts the shelf of the lower piece.

The threads on the shaft are preferably deformed below the shelf on the lower piece to prevent the shaft from being removed from the shelf on the lower piece.

Preferably, the shaft includes a head having a lower surface for engaging a top portion of the shelf on the upper piece.

The shaft is, for example, part of a screw having a head with a lower surface for engaging a top portion of the shelf on the base of the upper piece. The lower piece is preferably formed from sheet metal, and the shelves thereof includes a batting upper and lower parts having edges remote from the base of the lower part that are connected by a bent part. Threads in apertures in the upper and lower parts are aligned so that they engage threads on the shaft.

The above and still further objects, features and advantages of the present invention will become apparent upon consideration of the following detailed description of a specific embodiment thereof, especially when taken in conjunction with the accompanying drawings.

DETAILED DESCRIPTION OF THE DRAWINGS

Figure 2:
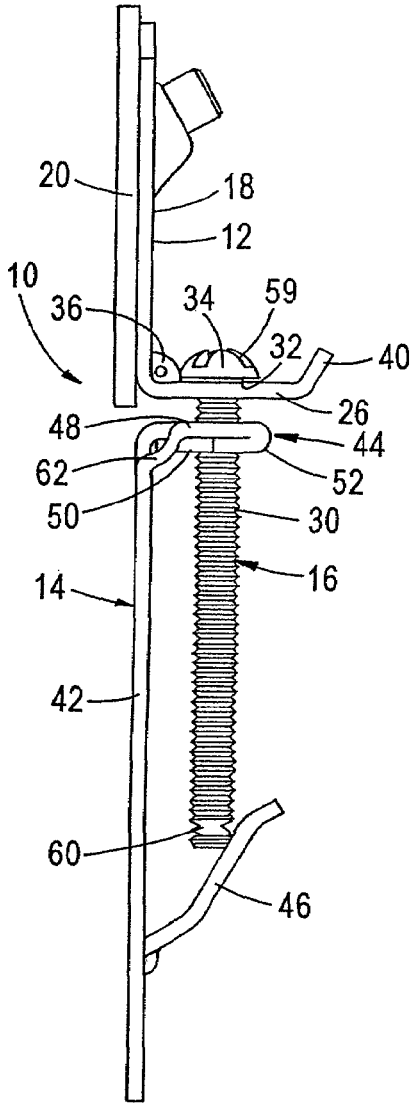
FIG. 2 is a side view of the picture hanger illustrated in FIG. 1.
Figure 1:
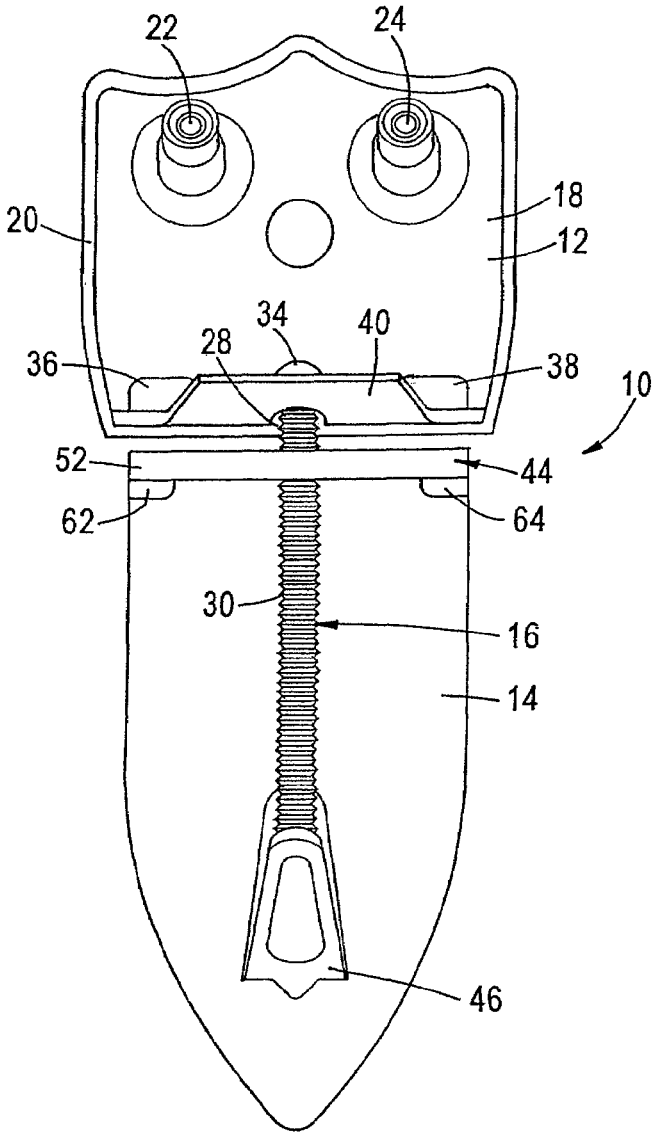
FIG. 1 is a front view of a preferred embodiment of a picture hanger in accordance with the present invention.

Reference is now made to the drawings wherein adjustable height hanger 10 is illustrated as including top piece 12, lower piece 14 and Philips head screw 16. Screw 16 connects upper and lower pieces 12 and 14 together and has threads for engaging corresponding threads in the lower piece, to enable the lower piece to be raised and lowered relative to the upper piece. Each of pieces 12 and 14 is fabricated from a single piece of cold rolled band steel or carbon steel and is brass plated. Similarly, screw 16 is fabricated from steel and includes brass plating.

Upper piece 12 includes base 18 having a planar rear face on which is securely and fixedly mounted pad 20, as described in Weck et al., U.S. Pat. Nos. 6,095,465 and 6,206,334. Base 18 includes apertures 22 and 24, equally spaced from a vertical centerline of the base, and located toward the top of the base. Apertures 22 and 24 are arranged to receive an elongated fastener, such as a nail, that is driven into pad 20, thence into a vertical surface, typically a wall, on which adjustable height hanger 10 is to be mounted. Hence, the elongated fasteners hold base 18 and upper piece 12 fixedly in place on the vertical surface.

Shelf 26 extends outwardly, in a horizontal direction, from the bottom of base 18 so that the shelf is at right angles to the base. Shelf 26 and the lower portion of base 18 include central elongated aperture (that is, slot) 28, aligned with the common centerline of upper piece 12 and base 18. Threaded shaft 30 of screw 16 extends vertically through elongated aperture 28, while the bottom planar surface 32 of head 34 of screw 16 extends beyond the edges of the slot and bears against the upper face of shelf 26.

A strengthening structure, in the form of ribs 36 and 38 having arcuate surfaces, assists in connecting shelf 26 to base 18. Each of ribs 26 and 28 has an angular extent of approximately 90°, with an upper end abutting base 18 and a lower end abutting shelf 26. The outer edges of ribs 36 and 38 are respectively proximate the left and right edges of base 18 and shelf 26, while the inner edges of ribs 36 and 38 are respectively displaced to the left and right of the centerline of upper piece 12.

The end 40 of shelf 26 remote from base 18 is tilted upwardly and includes a portion of slot 28. The upwardly tilted end 40 of shelf 26 functions as a stop for preventing screw 16 from escaping from the slot.

Lower piece 14 includes base 42 from which extend shelf 44 and hook 46 in a direction away from the planar back face of base 42. Hook 46, located toward the bottom of base 42, is arranged to receive and hold a thin elongated support structure, typically a metal wire, attached to an object, such as a picture or a mirror or the like, to be hung on adjustable height hanger 10.

Figure 3:
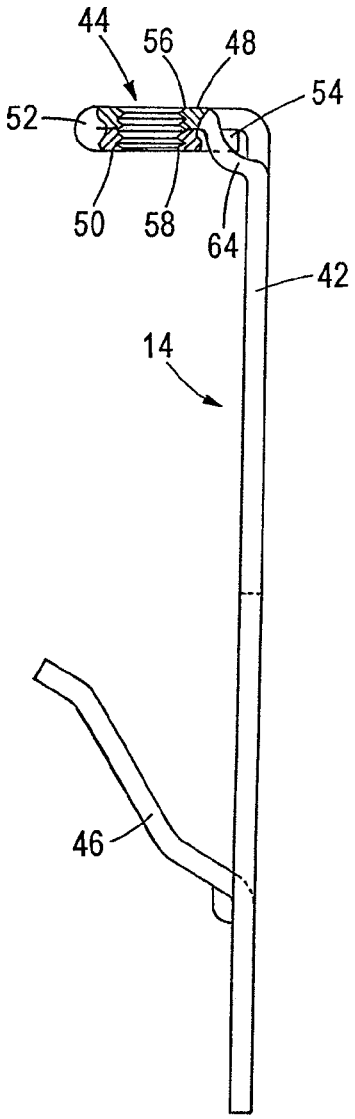
FIG. 3 is a cross-sectional view of the lower piece of the picture hanger of FIGS. 1 and 2.
Figure 4:
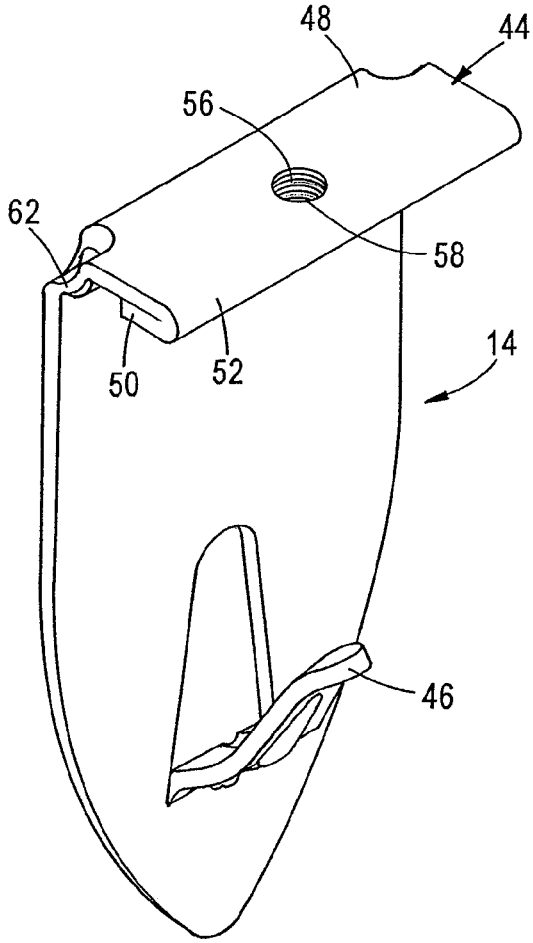
FIG. 4 is a perspective view of the lower piece of the picture hanger of FIGS. 1 and 2.
Figure 5:
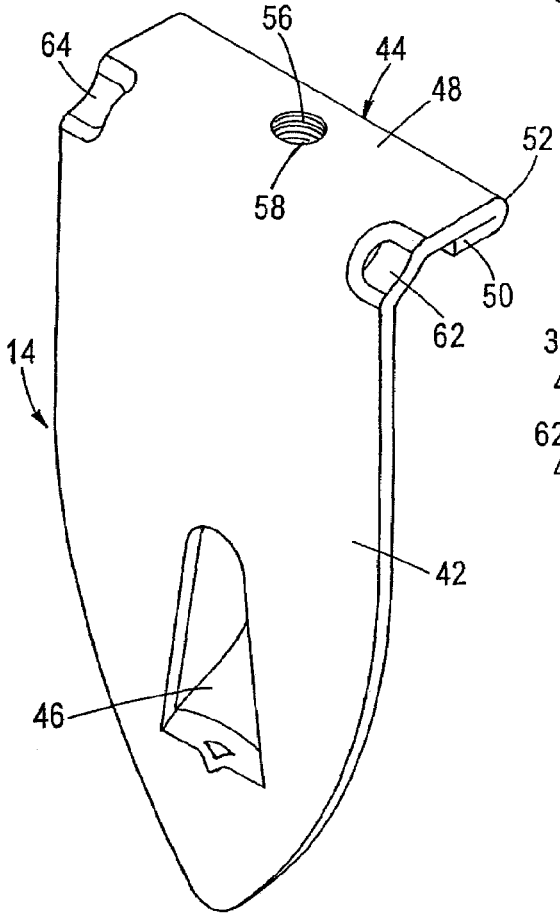
FIG. 5 is a back view of the lower piece of the picture hanger of FIGS. 1 and 2.
Figure 6:
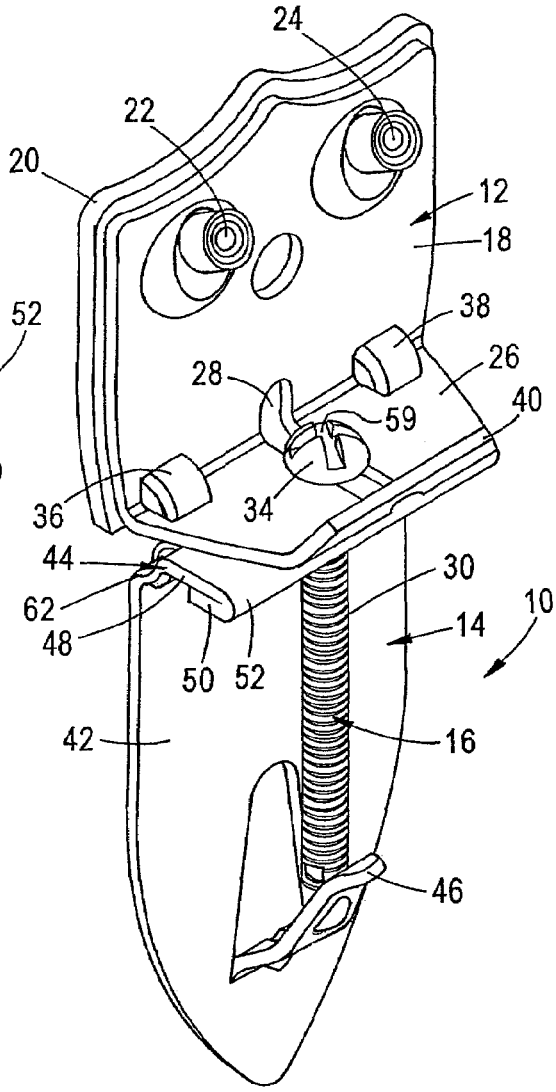
FIG. 6 is a perspective view of the picture hanger of FIGS. 1 and 2.

Shelf 44 includes upper portion 48 that extends from the top of base 42 and lower portion 50 and folded portion 52 that extends between the edges of the upper and lower portions 48 and 50 that are remote from base 42. The planar bottom face of upper portion 48 abuts the planar upper face of lower portion 50 having an end 54 remote from the folded portion 52. End 54 is in close proximity to base 42, as illustrated in FIG. 3. Upper and lower portions 48 and 50 of shelf 44 respectively include aligned threaded bores 56 and 58 having threads that mate with the threads on threaded shaft 30 of screw 16. By forming shelf 44 in this manner, a relatively thin sheet of plated steel, having a thickness of 1 mm (i.e., 18-gauge or 0.048") can be used to form a lower piece 14 and provide a large enough number of threads in both bores 56 and 58 to hold the threads of shaft 30 in place when a substantial load (e.g., 50 lbs.) is on hook 46.

When upper piece 12 is fixedly mounted on the vertical surface by the nails that extend through apertures 22 and 24, lower piece 14 is held in place only by the threads of shaft 30 of screw 16 engaging the threads in the apertures 56 and 58 on shelf 44 of the lower piece. To adjust the height of lower piece 14 relative to the fixed position of upper piece 12 and thereby adjust the height of the object attached to the wire that will be inserted in hook 46 relative to the fixed height of upper piece 12, an installer only needs to insert a screwdriver into the slots 59 in head 34 of screw 16 and turn the screwdriver in the desired direction. The threads on the lower portion 60 (above the bottom of the threads) on shaft 30 are notched (i.e., deformed) to prevent the shaft from being removed from shelf 44. Notched portion 60 is above the lowermost portion of the threads on shaft 30 and below shelf 44 on lower piece 14.

A strengthening structure, in the form of ribs 62 and 64 having arcuate surfaces, assists in connecting shelf 44 to base 42. Each of ribs 62 and 64 has an angular extent of approximately 90°, with a lower end abutting base 42 and an upper end abutting shelf 44. The outer edges of ribs 62 and 64 are respectively coincident with the left and right edges of base 42 and shelf 44, while the inner edges of ribs 62 and 64 are respectively displaced to the right and left of the left and right edges of base 42 and shelf 44. Hence, ribs 62 and 64 form indentations in the left and right edges of base 42 and shelf 44.

While a specific embodiment of the invention has been described and illustrated, variations regarding details of the embodiment specifically illustrated and described may be made without departing from the true spirit and scope of the invention as defined in the appended claims.

What is claimed is:

1. A hanger for an object adapted to be hung on a vertical surface comprising: an upper piece, a lower piece, and a shaft including threads, each of the upper and lower pieces including a base from which extends a shelf with an aperture for receiving the shaft, the apertures on the shelves of the bases of the upper and lower pieces being arranged for enabling the shaft to extend through the apertures on the shelves of the bases of the upper and lower pieces, the base of the upper piece including at least one aperture for receiving an elongated fastener for enabling the upper piece to be fixedly mounted on the vertical surface, the shelf on the upper piece and the shaft being arranged for enabling the shaft to be held vertically in place while the upper piece is fixedly mounted on the vertical surface, the aperture on the base of the lower piece including threads that mate with the threads on the shaft so that when the upper piece is fixedly mounted on the vertical surface by the elongated fastener the lower piece is held in place only by the threads of the shaft engaging the threads in the aperture on the shelf of the lower piece, the base of the lower piece carrying a hook for receiving an elongated support structure attached to the object, the lower piece consisting of one piece of sheet steel, the shelf on the lower piece including (a) an upper portion that extends from the upper edge of the base of the lower piece, (b) a lower portion having an upper face that abuts the lower face of the upper portion, and (c) a folded portion connecting the ends of the upper and lower portions remote from the base, the upper and lower portions including aligned bores with threads that mate with the threads on the shaft so that the threads on the aligned bores are the threads on the shelf of the lower piece.

2. The hanger of claim 1, wherein the threads on the shaft are deformed below the shelf on the lower piece to prevent the shaft from being removed from the shelf on the lower piece.

3. The hanger of claim 2, wherein the shaft includes a head having a lower surface for engaging a top portion of the shelf on the upper piece.

4. The hanger of claim 1, wherein the shaft includes a head having a lower surface for engaging a top portion of the shelf on the upper piece.

5. The hanger of claim 1, wherein the shaft is part of a screw having a head with a lower surface for engaging a top portion of the shelf on the upper piece, and the threads on the shaft of the screw are deformed below the shelf on the lower piece to prevent the shaft from being removed from the shelf on the lower piece.

6. The hanger of claim 1, further including a strengthening structure between the base and shelf of at least one of the upper and lower pieces.

7. The hanger of claim 6, wherein the strengthening structure includes first and second ribs proximate (a) first and second opposite ends of the shelf and (b) first and second opposite edges of the base of the upper piece.

8. The hanger of claim 7, wherein the strengthening ribs are included on the upper piece, each of the strengthening ribs on the upper piece including an arcuate surface having an angular extent of approximately 90°, a first upper end of each arcuate surface abutting the base of the upper piece and a second lower end of each arcuate surface abutting the shelf of the upper piece.

9. The hanger of claim 7, wherein the strengthening ribs are included on the lower piece, and each of the strengthening ribs on the lower piece including an arcuate surface having an angular extent of approximately 90°, a first lower end of each arcuate surface abutting the base of the lower piece and a second higher end of each arcuate surface abutting the shelf of the lower piece.

10. The hanger of claim 1, further including a strengthening structure between the base and shelf of both the upper and lower pieces.

* * * * *